US009719206B2

(12) United States Patent
Blakely

(10) Patent No.: US 9,719,206 B2
(45) Date of Patent: Aug. 1, 2017

(54) APPAREL WITH HEAT RETENTION LAYER AND METHOD OF MAKING THE SAME

(75) Inventor: Kyle Sanders Blakely, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 13/618,835

(22) Filed: Sep. 14, 2012

(65) Prior Publication Data

US 2014/0079920 A1 Mar. 20, 2014

(51) Int. Cl.
*D06P 5/00* (2006.01)
*A41B 17/00* (2006.01)
(Continued)

(52) U.S. Cl.
CPC ..... *D06P 5/001* (2013.01); *A41B 17/00* (2013.01); *D06M 11/79* (2013.01);
(Continued)

(58) Field of Classification Search
CPC ..... B32B 9/005–9/007; B32B 2264/10–2264/108; B32B 27/12; B32B 5/02–5/12; B32B 5/24–5/28; B32B 2255/02; D06N 3/0063; D06N 3/14; D06N 3/141; D06N 3/142; D06N 3/143; D06N 3/144; D06N 3/145; D06N 3/146; D06N 3/147; D06N 3/148; D06N 2211/10; D06N 2211/103; D06N 2211/106; D06M 11/76; D06M 15/564; D06M 15/568; D06M 15/572; D06M 15/576; D06M 15/579;
(Continued)

(56) References Cited

U.S. PATENT DOCUMENTS 2,695,895 A 11/1954 Barnard et al.
3,849,802 A 11/1974 Govaars
(Continued)

FOREIGN PATENT DOCUMENTS

CN 1094928 11/1994
CN 2484763 4/2002
(Continued)

OTHER PUBLICATIONS

Machine Translation of EP 1816254A.*
(Continued)

*Primary Examiner* — Frank Vineis
(74) *Attorney, Agent, or Firm* — Edell, Shapiro & Finnan, LLC

(57) ABSTRACT

An article of apparel includes a fabric portion having an inside and an outside defined by the article of apparel. A ceramic print is provided on the inside of the fabric portion. The ceramic print includes at least five percent of a ceramic by weight and covers at least ten percent of the inside of the fabric portion. A method of manufacturing the article of apparel includes first printing an ink comprising at least five percent of a ceramic by weight onto a first side of a fabric portion in order to provide a fabric with a ceramic print that covers at least ten percent of the inside of the fabric portion. The method further includes incorporating the fabric with the ceramic print into a garment with the first side of the fabric portion exposed on an inside of the garment.

16 Claims, 4 Drawing Sheets

(51) Int. Cl.
*D06M 11/79* (2006.01)
*D06M 15/564* (2006.01)

(52) U.S. Cl.
CPC ..... *A41D 2400/10* (2013.01); *D06M 15/564* (2013.01); *D10B 2501/00* (2013.01); *Y10T 428/2481* (2015.01)

(58) Field of Classification Search
CPC ..... D06M 23/169; D06P 5/001; C08K 3/36; C08L 266/58
USPC ..... 442/131–133; 428/103, 195.1–211.1, 428/423.1, 446, 689, 331, 387; 427/2.31, 427/256, 286, 288, 387; 106/31.13, 31.6, 106/31.9, 257.34, 482; 607/96, 100–103, 607/108–111; 423/335
See application file for complete search history.

(56) References Cited

U.S. PATENT DOCUMENTS

| | | | | |
|---|---|---|---|---|
| 4,211,261 | A | 7/1980 | Mehta et al. | |
| 4,316,931 | A | 2/1982 | Tischer et al. | |
| 4,420,521 | A | 12/1983 | Carr | |
| 4,569,874 | A | 2/1986 | Kuznetz | |
| 4,622,253 | A | 11/1986 | Levy | |
| 4,637,947 | A | 1/1987 | Maekawa et al. | |
| 4,856,294 | A | 8/1989 | Scaringe et al. | |
| 5,072,455 | A | 12/1991 | St. Ours | |
| 5,073,222 | A | 12/1991 | Fry | |
| 5,098,795 | A | 3/1992 | Webb et al. | |
| 5,265,278 | A | 11/1993 | Watanabe | |
| 5,411,791 | A | 5/1995 | Forry et al. | |
| 5,792,714 | A | 8/1998 | Schindler et al. | |
| 6,007,245 | A | 12/1999 | Looy | |
| 6,089,194 | A | 7/2000 | LaBelle | |
| 6,219,852 | B1 | 4/2001 | Bain et al. | |
| 6,321,386 | B1 | 11/2001 | Monica | |
| 6,332,221 | B1 | 12/2001 | Gracey | |
| 6,415,453 | B1 | 7/2002 | Anderson et al. | |
| 6,599,850 | B1 | 7/2003 | Heifetz | |
| 6,824,819 | B2 | 11/2004 | Vogt et al. | |
| 6,931,665 | B2 | 8/2005 | Feduzi et al. | |
| 7,043,761 | B2 | 5/2006 | Epling | |
| 7,217,456 | B1 | 5/2007 | Rock et al. | |
| 7,428,772 | B2 | 9/2008 | Rock | |
| 7,743,476 | B2 | 6/2010 | Rock et al. | |
| 7,977,261 | B2 | 7/2011 | Szczesuil | |
| 8,028,386 | B2 | 10/2011 | Rock et al. | |
| D655,921 | S | 3/2012 | Snyder | |
| D657,093 | S | 4/2012 | Snyder | |
| D666,837 | S | 9/2012 | Elser | |
| 8,424,119 | B2 | 4/2013 | Blackford | |
| 8,453,270 | B2 | 6/2013 | Blackford | |
| 8,479,322 | B2 | 7/2013 | Blackford et al. | |
| 8,510,871 | B2 | 8/2013 | Blackford et al. | |
| 2002/0137417 | A1 | 9/2002 | Tebber | |
| 2002/0189608 | A1 | 12/2002 | Raudenbush | |
| 2003/0054141 | A1* | 3/2003 | Worley | A41D 31/0038 428/195.1 |
| 2005/0009429 | A1 | 1/2005 | Park et al. | |
| 2006/0135019 | A1 | 6/2006 | Russell et al. | |
| 2007/0022510 | A1 | 2/2007 | Chapuis et al. | |
| 2008/0155729 | A1 | 7/2008 | Schwarz | |
| 2009/0061131 | A1 | 3/2009 | Monfalcone et al. | |
| 2010/0058509 | A1 | 3/2010 | Lambertz | |
| 2010/0269242 | A1 | 10/2010 | Stubiger | |
| 2010/0282433 | A1* | 11/2010 | Blackford | 165/46 |
| 2011/0041230 | A1 | 2/2011 | Huang et al. | |
| 2011/0083246 | A1 | 4/2011 | Vitarana | |
| 2013/0014311 | A1 | 1/2013 | Chapuis | |
| 2013/0160193 | A1 | 6/2013 | Cremin | |

FOREIGN PATENT DOCUMENTS

| | | | | |
|---|---|---|---|---|
| CN | 101405452 | | | 4/2009 |
| CN | 201509611 | U | | 6/2010 |
| DE | 247637 | A | | 7/1987 |
| EP | 1816254 | A1 | | 8/2007 |
| GB | 2205533 | | | 12/1988 |
| GB | 2350073 | A | * | 11/2000 |
| GB | 2389073 | A | | 12/2003 |
| JP | 01188336 | A | | 7/1989 |
| JP | 01207403 | A | | 8/1989 |
| JP | H01207403 | | | 8/1989 |
| JP | 02182968 | A | * | 7/1990 |
| JP | 03033251 | A | | 2/1991 |
| JP | 03051301 | A | | 3/1991 |
| JP | 03137284 | A | | 6/1991 |
| JP | 03167301 | A | | 7/1991 |
| JP | 05186728 | A | | 7/1993 |
| JP | H1150378 | | | 2/1999 |
| JP | 2000129566 | A | | 5/2000 |
| JP | 2000129567 | A | | 5/2000 |
| JP | 2001337601 | A | | 12/2001 |
| JP | 2002088647 | A | | 3/2002 |
| JP | 2002166505 | A | | 6/2002 |
| JP | 2002371465 | A | | 12/2002 |
| JP | 2003236971 | A | | 8/2003 |
| JP | 2003239111 | | | 8/2003 |
| JP | 2003239111 | A | | 8/2003 |
| JP | 3096192 | U | | 9/2003 |
| JP | 2006348414 | A | | 12/2006 |
| JP | 2010043388 | A | | 2/2010 |
| KR | 20030019662 | A | | 3/2003 |
| TW | 571009 | B | | 1/2004 |
| TW | 200949043 | A | | 12/2009 |
| WO | 0232692 | | | 4/2002 |
| WO | 02103108 | | | 12/2002 |
| WO | 2005049745 | | | 6/2005 |
| WO | 2011114025 | | | 9/2011 |

OTHER PUBLICATIONS

Koo, K., "The application of PCMMcs and SiC by commercially direct dual-complex coating on textile polymer", Applied Surface Science, 255 (2009), 8313-8318.*
Gangolli, S., "The Dictionary of Substances and their Effects", Royal Society of Chemistry, 3rd Edition, 2005, p. s29.*
Shim, Far IR Emission and Thermal Properties of Ceramics Coated Fabrics by IR Thermography, Key Engineering Materials vols. 321-323 (2006) pp. 849-852.*
"Molten", The American Heritage Dictionary of the English Language, Houghton Mifflin Harcourt Publishing, 2015.*
Machine Translation of JP 2002-371465A.*

* cited by examiner

APPAREL WITH HEAT RETENTION LAYER AND METHOD OF MAKING THE SAME

FIELD

This application relates to the field of textiles, and particularly to garments and other articles of apparel designed for heat retention.

BACKGROUND

It is often desirable for a garment to include heat retention features. For example, athletic performance apparel, including hunting jackets, boots, and other articles of apparel intended for outdoor use may include multiple layers and various materials designed to retain body heat in order to keep the wearer warm in cold weather. It is generally desirable for such garments and other articles of apparel to be relatively light in weight and capable of providing heat retention features without sacrificing other qualities, such as garment breathability and moisture wicking.

Ceramic materials have been used on garments in the past to provide heat retention qualities. Such ceramic materials are typically added as a thin layer to fabric and provide good heat retention features for the garment. Unfortunately, conventional ceramic materials and methods of applying such ceramic materials have diminished garment performance in other areas, including poor breathability and moisture management. In addition, many ceramic materials added to garments have resulted in an undesirable finish and have deteriorated quickly with repeated washing and wear. Furthermore, various alternative materials to ceramics which are capable of providing heat retaining qualities have result in garments with other undesirable qualities. For example, some alternative heat retaining materials provide an undesirable shiny finish on the garment with poor breathability and wash-fastness.

In view of the foregoing, it would be advantageous to provide garments and other articles of apparel incorporating ceramic materials for heat retention without sacrificing other performance qualities. It would be advantageous if such garments provided excellent heat retention qualities while retaining good durability, breathability and moisture wicking qualities. Additionally, it would be advantageous if such garments provided a comfortable look and feel for the wearer.

SUMMARY

In accordance with at least one embodiment, an article of apparel comprises a fabric portion including an inside and an outside defined by the article of apparel. A ceramic print is provided on the inside of the fabric portion. The ceramic print includes at least two percent of a ceramic by weight. Additionally, the ceramic print covers at least ten percent of the inside of the fabric portion.

In at least one embodiment, a method of manufacturing a garment is provided by printing an ink comprising at least five percent of a ceramic by weight on to a first side of a fabric portion in order to provide a fabric with a ceramic print. The ceramic print covers at least ten percent of the inside of the fabric portion. The method further includes incorporating the fabric with the ceramic print into a garment with the first side of the fabric portion provided on an inside of the garment and exposed on the inside of the garment.

Furthermore, in at least one embodiment, an article of apparel comprises a sheet of material with an inside of the sheet of material defined by an inside of the article of apparel. A pattern is provided on the inside of the sheet of material, the pattern includes ceramic portions and non-ceramic portions. The ceramic portions of the pattern include at least five percent of a ceramic by weight and cover at least ten percent of the inside of the sheet of material. The ceramic portions of the pattern include a plurality of linear members and the non-ceramic portions of the pattern including a plurality of channels positioned between the linear members.

The above described features and advantages, as well as others, will become more readily apparent to those of ordinary skill in the art by reference to the following detailed description and accompanying drawings. While it would be desirable to provide a garment that provides one or more of these or other advantageous features, the teachings disclosed herein extend to those embodiments which fall within the scope of the appended claims, regardless of whether they accomplish one or more of the above-mentioned advantages.

DESCRIPTION

Figure 1:
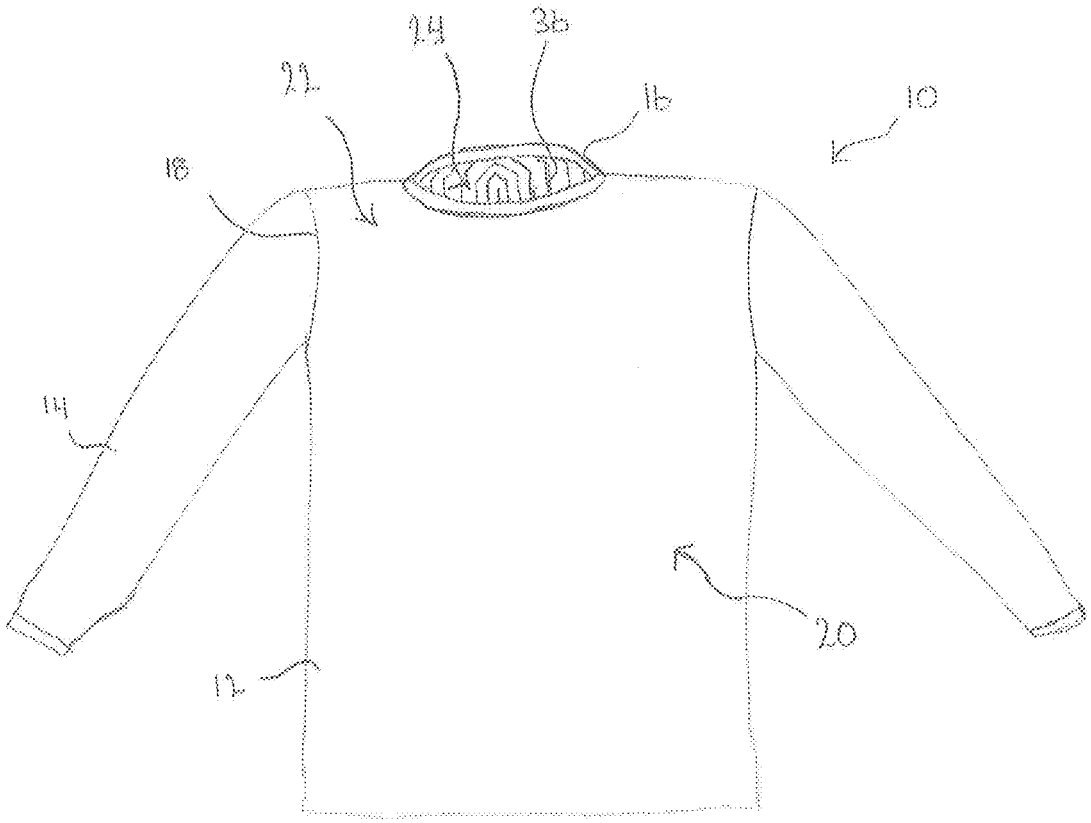
FIG. 1 is a front view of a shirt including a heat retention layer.

With reference to FIG. 1, in at least one embodiment, an article of apparel with a heat retention layer is provided in the form of a garment, and particularly a shirt 10. The shirt 10 includes a torso portion 12, arms 14, and a neck opening 16. The shirt 10 is comprised of one or more sheets of material, and particularly fabric panels 20 connected together to form the garment. Each fabric panel 20 includes an outer side 22 and an inner side 24, as defined by the intended configuration of the item of apparel when worn by a user. A ceramic print 36 is provided as an additional layer on the inner side 24 of the fabric panel 20 in order to provide a heat retention layer for the wearer of the garment.

Figure 2:
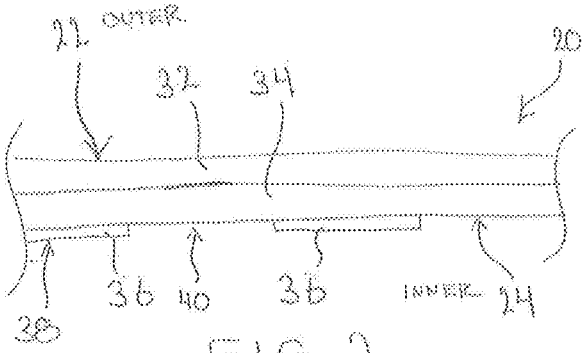
FIG. 2 is a cross-sectional view of fabric for the shirt of FIG. 1 including an outer layer, an inner layer, and a heat retention layer.

As shown in FIG. 2, in at least one embodiment, the fabric panel 20 is a multi-layer sheet of fabric including an outer layer 32 and an inner layer 34. The outer layer 32 and the inner layer 34 may be comprised of the same material or different materials. In at least one embodiment, the outer layer 32 and the inner layer 34 are both provided by a material comprised of polyester fibers. However, it will be recognized that the material may include any number of different fibers including cotton, nylon, or any of various other natural or synthetic fibers. In at least one embodiment, the material provided for the outer layer 32 and the inner layer 34 is a compression material that includes elastane or other elastic fibers. It will be recognized that the multi-layer fabric panel 20 disclosed herein is advantageous for providing heat retention qualities for the garment. However, in other embodiments the fabric panel 20 may be only a single layer rather than a multi-layer fabric. Additionally, in other embodiments, a sheet of material that is not fabric may be used instead of the fabric panel to form portions of the garment or other article of apparel.

With continued reference to FIG. 2, a ceramic print 36 is provided on the inner side 24 of the fabric panel 20. In at least one embodiment, the ceramic print 36 is provided by a layer of an aqueous solution or paste comprising a ceramic material. Such aqueous solutions or pastes comprising a ceramic material are referred to herein as "ceramic inks". However, it will be recognized that such ceramic inks need not be applied to the fabric panel 20 in any particular manner or with any particular device.

In at least one embodiment, the ceramic ink comprises at least two percent ceramic by weight and less than fifty percent ceramic by weight. In at least one embodiment, the ceramic print is provided by an ink comprising between five percent and fifteen percent ceramic by weight, and particularly about ten percent ceramic by weight. The ceramic may be any of various ceramics appropriate for inclusion on a fabric including both oxide ceramics and non-oxide ceramics. In at least one embodiment, the ceramic material in the ceramic print is a high temperature molten silica. However, it will be recognized that the ceramic may be any of various other ceramic materials such as zirconium carbide, aluminum oxide, or any of various other ceramic materials.

As shown in FIG. 2, the ceramic print 36 does not completely cover the inner side 24 of the fabric panel 20. Accordingly, the ceramic ink may be provided on the fabric panel 20 in a pattern that provides ink covered portions 38 and non-ink portions 40 on the inner side 24 of the fabric panel 20. The non-ink portions are generally voids in the print pattern that expose the inner surface of the fabric panel 20. In this manner, the ink covered portions 38 and the non-ink portions define a discontinuous print on the fabric panel 20. In at least one embodiment, the ceramic print 36 covers between twenty percent and eighty percent of the inner side 24 of the fabric panel 20 (i.e., twenty to eighty percent of the surface area on the inner side 24 of the fabric portion 20 is covered by an ink covered portion 38). More particularly, in at least one embodiment, the ceramic print 36 covers between thirty and fifty percent of the inner side 24 of the fabric panel 20, and particularly about forty percent of the inner side 24 of the fabric panel 20.

Figure 3:
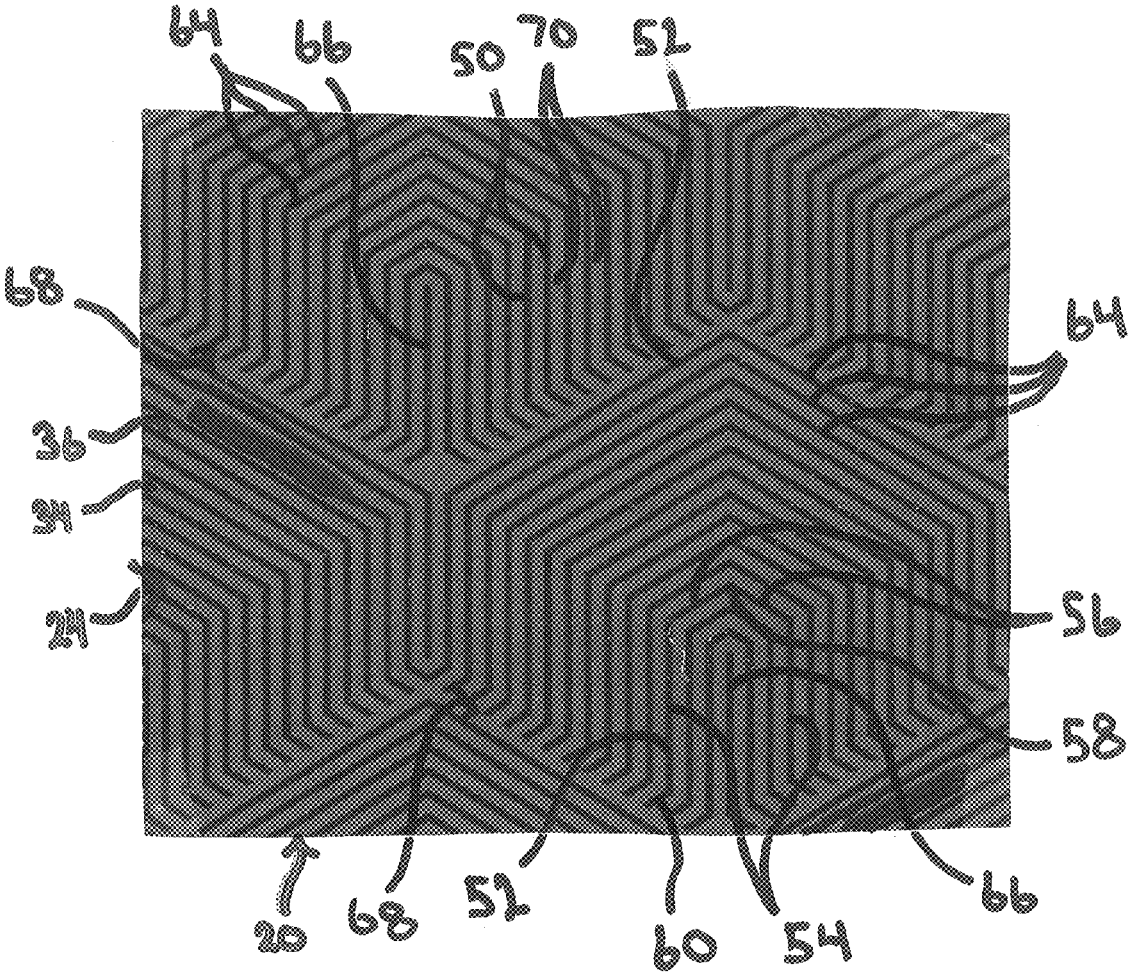
FIG. 3 is a bottom view of the fabric of FIG. 2 showing a pattern for the heat retention layer on the inner layer.

With reference now to FIG. 3, an exemplary pattern for the ceramic print 36 is shown on the inner side 24 of the fabric panel 20. The pattern includes a plurality of linear members 50 provided by the ink covered portions 38 and a plurality of channels 70 provided by the non-ink portions. In the embodiment of FIG. 3, the plurality of linear members 50 include partial hexagon shapes. The plurality of partial hexagon shapes include four linear member 50 that are connected together to form a house shape 52 characterized by two parallel walls 54 connected to two angled roof portions 56 that meet at an apex 58. Additionally, in the embodiment of FIG. 3, most of the house shapes 52 include two additional linear members 50 provided by a short leg 60 positioned at the base of each parallel wall 54. Each short leg 60 is parallel to one of the roof sections 56.

The house shapes 52 are provided in a nested arrangement 64, as shown in FIG. 3, with successively smaller house shapes positioned to the inside of larger house shapes. In various embodiments, between three and twenty house shapes 52 are nested together. However, it will be recognized that any number of house shapes 52 may be utilized within the nested arrangement 64. A single linear member 66 is provided at a middle of the nested arrangement 64. Each successively smaller house shape is positioned slightly lower in the nested arrangement 64 than the immediately larger house shape. As a result, the ends of the short legs 60 provide a broken border 68 on the lower side of the nested arrangement 64. This broken border 68 includes two sides that angle toward one another at an angle that is equivalent to the angle of the roof portions 56. This broken border 68 on the lower side of the nested arrangement 64 also completes a hexagonal shape for the nested arrangement 64 defined by the largest house shape of the nested arrangement 64 on an upper portion of the hexagon and the broken border 68 on the lower portion of the hexagon.

As shown in FIG. 3, the pattern for the ceramic print 36 may include a plurality of nested arrangements 64 positioned adjacent to each other in a honeycomb-like manner. In particular, each side of the hexagon provided by one nested arrangement 64 is adjacent to another side of the hexagon provided by another nested arrangement 64. Thus, a given nested arrangement 64 may be surrounded by six immediately adjacent nested arrangements 64 on the ceramic print 36. In the embodiment of FIG. 3, at least some of the linear members 50 of different nested arrangements 64 contact one another. For example, two short legs 60 on the lateral sides of adjacent nested arrangement 64 may contact one another, as noted by contact point 69 in FIG. 3.

With continued reference to FIG. 3, the channels 70 positioned between the linear members 50 provide void areas that expose the inner side 24 of the fabric panel 20. Accordingly, the fabric panel 220 remains uncovered by the ceramic print 36 along the channels 70. A sufficient number of channels 70 are positioned between the linear members 50 such that between ten percent and ninety percent of the area on the inner side 24 of the fabric panel 20 remains uncovered by the ceramic print 36. It has been determined that advantages may be realized by covering less than the entire inner side 24 of the fabric panel 20, but at least a certain percentage of the inner side. In particular, desirable feel and heat retention qualities may be realized when the print coverage is within a certain range without sacrificing other fabric qualities such as breathability, moisture wicking and elasticity. Accordingly, in at least one embodiment that results in acceptable performance qualities, the ceramic print 36 covers between twenty percent and eighty percent of the area on the inner side 24 of the fabric panel 20. More specifically, in at least one embodiment, the ceramic print covers between thirty percent and fifty percent of the area on the inner side 24 of the fabric panel 20. Even more particularly, the ceramic print may cover about forty percent of the area on the inner side 24 of the fabric panel 20. In addition to overall print area effecting performance, it has been determined that the actual pattern of the ceramic print 36 may have an influence on performance. Thus, in addition to providing a desirable coverage for good fabric performance, the actual print pattern shown in FIG. 3 also provides excellent fabric performance characteristics with respect to heat retention, feel, breathability, and moisture wicking.

While the ceramic print 36 has been described herein as covering some percentage of the area on inner side 24 of the fabric panel 20, it will be recognized that it is desirable to distribute the ceramic print evenly over the coverage area. For example, a ceramic print could cover fifty percent of a fabric panel by covering all of the left side of the panel, but none of the right side. However, it is generally more desirable for the ceramic print 36 to be provided in a pattern that extends over the entire fabric panel 20, while the ink portions 38 of the ceramic print 36 cover only some percentage of the overall fabric panel 20. Accordingly, a print pattern such as that shown in FIG. 3 is desirable. As discussed above, such a pattern may extend over a large area of the fabric panel 20 with the ink portions 38 only covering some percentage of the large area, and the remaining percentage being uncovered (i.e., a non-ink portion). Additionally, in some embodiments, it may be desirable for a single fabric panel to include the ceramic print on most of the panel but have some portion of the panel free of the ceramic print. For example, it may be desirable to leave the portion of a fabric panel that will be used in an underarm area free of the ceramic print in order to increase breathability in that area. Accordingly, it will be recognized that the term "fabric portion" as used herein refers to at least some part of at least one fabric panel. Accordingly, the ceramic print 36 may be provided on a "fabric portion" that includes all or only part of a given fabric panel. Additionally, the ceramic print 36 may be provided on a "fabric portion" that extends over all or parts of a plurality of fabric panels of a garment.

Figure 4:
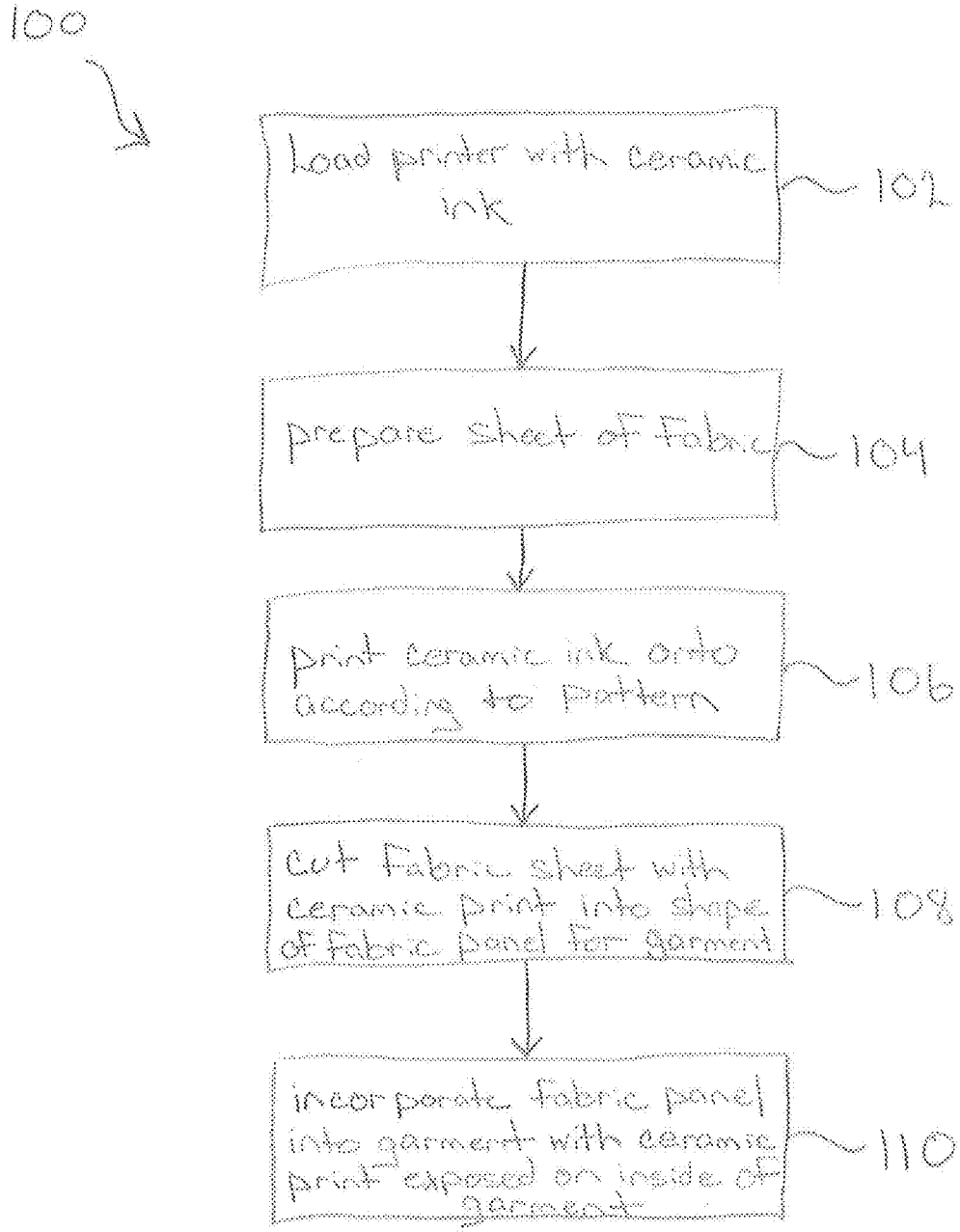
FIG. 4 is a block diagram showing a method for making an article of apparel including with the heat retention layer of FIG. 3.

With reference now to FIG. 4, a method of manufacturing an article with the ceramic print 100 begins with step 102 where a printer is loaded or otherwise prepared with ceramic ink. As described above, the ceramic ink includes at least five percent ceramic by weight and less than fifty percent ceramic by weight. In at least one embodiment, the ceramic ink comprises about ten percent ceramic by weight. The ceramic ink may be formed by adding an appropriate quantity of ceramic powder to an existing quantity of ink. The ceramic powder may be provided by any of various ceramic powders including both oxide ceramics and non-oxide ceramics. The printer that uses the ceramic ink may be any of various types of printers capable of printing a ceramic ink on a surface, including screen printers, impression or foil printers, inkjet printers, or other types of printers as will be recognized by those of ordinary skill in the art. Moreover, it will be recognized that any of various methods may be used to adhere or otherwise bind the ceramic ink to the fabric including adhesion printing or other binding methods or materials such as a polyurethane binder.

With continued reference to FIG. 4, the method of manufacturing an article continues with step 104 where a sheet of fabric or other material is provided and prepared for engagement with a printer. As described previously, the sheet of fabric may be, for example, a fabric with elastic qualities, such as a compression fabric including elastane fibers. The sheet of fabric is generally prepared such that the sheet may be fed into the printer or otherwise placed on a printing surface.

At step 106, the printer prints the ceramic ink onto the sheet of fabric according to a predetermined pattern. As a result of the pattern, the printed sheet of fabric will include print covered portions where the ink has been printed on the surface of the fabric, and non-print portions where no ink is on the surface of the fabric. In at least one embodiment, the predetermined pattern is similar to that described above with reference to FIG. 3. In such embodiment, the pattern includes a plurality of linear members 50 that substantially form partial-hexagonal shapes 52, or house shapes, with channels 70 extending between the linear members.

Next, in step 108, the fabric with the printed pattern is cut into a shape that forms a fabric panel of a garment or other article of apparel. The fabric panel may be any of various fabric panels for use on the article of apparel, such as fabric panel for a torso portion of a shirt, a fabric panel for a sleeve, a fabric panel for a shoe upper, or any of various other fabric panels.

In step 110, the formed fabric panel is incorporated into a garment. The fabric panel is arranged on the garment such that the ceramic print on the fabric is exposed on the inside of the garment. Placement of the ceramic print on the inside of the garment can have particular advantages as improved heat retention is provided when the ceramic print is provided in direct contact with the skin of the wearer.

The garment 10 with the ceramic print 36 has been demonstrated to provide excellent performance characteristics with respect to heat retention, while also retaining good performance characteristics in other areas such as moisture retention and breathability. One example test illustrating these performance characteristics is provided below.

Example Testing

Experiments were conducted on fabrics with the ceramic print as described above in comparison to various commercially available fabrics with or without added heat retention features. These experiments utilized a hot plate to expose the test fabrics to a conductive heat source. First, the test fabrics were cut into appropriate samples sizes (e.g., 5×5 inch fabric swatches) to be tested and then were allowed to condition at 45 degrees Fahrenheit for 24 hours. Next, a copper plate was placed on a hot plate and allowed to heat up to 85 degrees Fahrenheit. After the copper plate was heated to 85 degrees Fahrenheit, the sample fabric was placed on the copper plate and observed with a thermal imaging camera. The samples were exposed to the copper plate for 10 minutes. After this 10 minute duration, the copper plate and fabric sample were moved to a cooling rack away from the heat source. The fabric sample was then observed while cooling for an additional 10 minutes with the thermal imaging camera.

Figure 5:
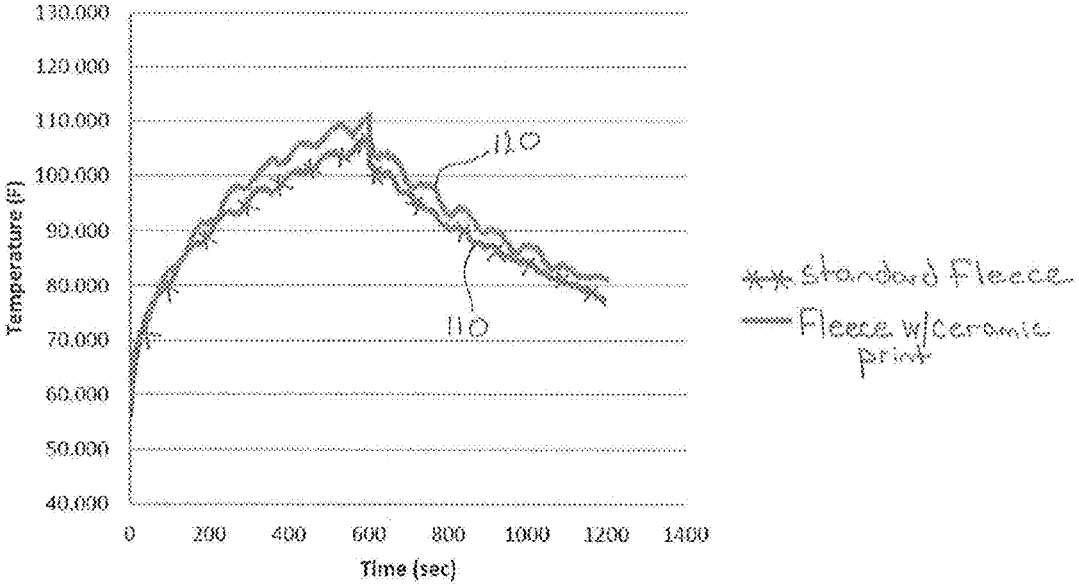
FIG. 5 is a chart illustrating the heat retention qualities of a fabric with the ceramic print described herein in comparison to the same fabric without the ceramic print described herein.

The results of the testing showed that fabrics treated with the ceramic print provided excellent heat retention qualities as well as excellent breathability, wear and wash-fastness. One exemplary test performed according to the above procedure evaluated a standard commercially available fleece fabric in comparison to the same fleece fabric with the above-described ceramic print applied to the fabric. The results of this test are shown in FIG. 5. Line 110 of FIG. 5 represents the standard fleece fabric without the above-described ceramic print. Line 120 represents the same standard fleece fabric with the above-described ceramic print. As shown in FIG. 5, the fleece 120 with the ceramic print significantly outperformed fleece 110 that did not include the ceramic print with respect to heat retention over time. In particular, the fabric 120 with the ceramic print warmed up more quickly than the standard fabric 110 over a ten minute warm-up period and also retained more heat over a ten minute cool-down period. The foregoing detailed description of one or more embodiments of garments with ceramics and methods of making the same are presented herein by way of example only and not limitation. It will be recognized that there are advantages to certain individual features and functions described herein that may be obtained without incorporating other features and functions described herein. Moreover, it will be recognized that various alternatives, modifications, variations, or improvements of the above-disclosed embodiments and other features and functions, or alternatives thereof, may be desirably combined into many other different embodiments, systems or applications. Furthermore, presently unforeseen or unanticipated alternatives, modifications, variations, or improvements therein may be subsequently made by those skilled in the art which are also intended to be encompassed by the appended claims. Therefore, the spirit and scope of any appended claims should not be limited to the description of the embodiments contained herein.

What is claimed is:

1. An article of apparel comprising:

fabric incorporated into the article of apparel, the fabric including:

an inner, user-facing surface having a surface area, and an outer surface; and a discontinuous ceramic layer applied to the inner fabric surface, the discontinuous ceramic layer defining printed portions and non-printed portions, the printed portions covering the inner fabric surface and the non-printed portions exposing the inner fabric surface, wherein the ceramic comprises molten silica, and the printed portions of the discontinuous ceramic layer covers from 20% to 80% of the surface area of the fabric inner surface, wherein each printed portion of the discontinuous ceramic layer comprises at least two percent ceramic by weight.

2. The article of apparel of claim 1, wherein each printed portion of the discontinuous ceramic layer comprises between five percent and fifteen percent of the ceramic by weight.

3. The article of apparel of claim 2, wherein each printed portion of the discontinuous ceramic layer comprises about ten percent of the ceramic by weight.

4. The article of apparel of claim 1, wherein each printed portion of the discontinuous ceramic layer comprises a binder and at least two percent of a ceramic powder by weight.

5. The article of apparel of claim 1, wherein:

the printed portions define a plurality of linear members; and the non-printed portions define a plurality of channels, each channel being positioned between adjacent linear members.

6. The article of apparel of claim 1, wherein the article of apparel including the discontinuous ceramic layer exhibits improved heat retention compared to an article of apparel lacking the discontinuous ceramic layer.

7. The article of apparel of claim 1, wherein the printed portions of the discontinuous ceramic layer comprise a plurality of linear members oriented in spaced relation, each linear member absorbing and retaining heat.

8. The article of apparel of claim 7, wherein each printed portion of the discontinuous ceramic layer comprises a binder.

9. The article of apparel of claim 8, wherein the binder is polyurethane.

10. The article of apparel of claim 1, wherein the printed portions of the discontinuous ceramic layer define areas of improved heat retention, the areas of improved heat retention being oriented in spaced relation from each other along the inner fabric surface.

11. The article of apparel of claim 1, wherein the printed portions are applied directly to the fabric inner surface.

12. The article of apparel of claim 1, wherein the printed portions include the ceramic and a binder effective to adhere to the fabric.

13. The article of apparel claim 1, wherein the printed portions contact the inner fabric surface.

14. The article of apparel of claim 1, wherein each printed portion of the discontinuous ceramic layer comprises at least five percent ceramic by weight.

15. The article of apparel of claim 1, wherein the discontinuous ceramic layer is positioned to contact a wearer of the apparel.

16. The article of apparel of claim 1, wherein the discontinuous ceramic layer is positioned on inside of the article of apparel such that the discontinuous ceramic layer contacts a wearer of the apparel.

* * * * *